US009262965B2

(12) United States Patent
Chaji et al.

(10) Patent No.: US 9,262,965 B2
(45) Date of Patent: Feb. 16, 2016

(54) SYSTEM AND METHODS FOR POWER CONSERVATION FOR AMOLED PIXEL DRIVERS

(71) Applicant: Ignis Innovation Inc., Waterloo (CA)

(72) Inventors: Gholamreza Chaji, Waterloo (CA); Jaimal Soni, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

(21) Appl. No.: 14/058,623

(22) Filed: Oct. 21, 2013

(65) Prior Publication Data

US 2014/0043316 A1 Feb. 13, 2014

Related U.S. Application Data

(63) Continuation-in-part of application No. 12/958,938, filed on Dec. 2, 2010, now Pat. No. 9,093,028.

(30) Foreign Application Priority Data

Dec. 6, 2009 (CA) ..... 2687631

(51) Int. Cl.
*G09G 3/32* (2006.01)

(52) U.S. Cl.
CPC ..... *G09G 3/3258* (2013.01); *G09G 3/3233* (2013.01); *G09G 3/3291* (2013.01); *G09G 2310/0254* (2013.01);
(Continued)

(58) Field of Classification Search
CPC ..... G09G 2310/0254; G09G 2310/066; G09G 2320/029; G09G 2320/043; G09G 2320/0673; G09G 2330/021
USPC ..... 345/76, 204, 690
See application file for complete search history.

(56) References Cited

U.S. PATENT DOCUMENTS 3,506,851 A 4/1970 Polkinghorn et al.
3,750,987 A 8/1973 Gobel
(Continued)

FOREIGN PATENT DOCUMENTS

AU 729652 6/1997
AU 764896 12/2001
(Continued)

OTHER PUBLICATIONS

Extended European Search Report mailed Apr. 27, 2011 issued during prosecution of European patent application No. EP 09733076.5 (13 pages).
(Continued)

*Primary Examiner* — Koosha Sharifi-Tafreshi
*Assistant Examiner* — Chun-Nan Lin
(74) *Attorney, Agent, or Firm* — Nixon Peabody LLP

(57) ABSTRACT

A system is provided for conserving energy in an AMOLED display having pixels that include a drive transistor and an organic light emitting device, and an adjustable source of a supply voltage for the drive transistor. The system monitors the content of a selected segment of the display, sets the supply voltage to the minimum supply voltage required for the current content of the selected segment of the display, determines whether the number of pixels requiring a supply voltage larger than the set value is greater than a predetermined threshold number, and, when the answer is negative, reduces the supply voltage by a predetermined step amount.

4 Claims, 8 Drawing Sheets

(52) U.S. Cl.
CPC ... *G09G 2310/066* (2013.01); *G09G 2320/029* (2013.01); *G09G 2320/043* (2013.01); *G09G 2320/0673* (2013.01); *G09G 2330/021* (2013.01); *G09G 2360/16* (2013.01)

(56) References Cited

U.S. PATENT DOCUMENTS

| | | | |
|---|---|---|---|
| 3,774,055 | A | 11/1973 | Bapat et al. |
| 4,090,096 | A | 5/1978 | Nagami |
| 4,160,934 | A | 7/1979 | Kirsch |
| 4,354,162 | A | 10/1982 | Wright |
| 4,943,956 | A | 7/1990 | Noro |
| 4,996,523 | A | 2/1991 | Bell et al. |
| 5,134,387 | A | 7/1992 | Smith et al. |
| 5,153,420 | A | 10/1992 | Hack et al. |
| 5,170,158 | A | 12/1992 | Shinya |
| 5,198,803 | A | 3/1993 | Shie et al. |
| 5,204,661 | A | 4/1993 | Hack et al. |
| 5,266,515 | A | 11/1993 | Robb et al. |
| 5,278,542 | A | 1/1994 | Smith et al. |
| 5,408,267 | A | 4/1995 | Main |
| 5,489,918 | A | 2/1996 | Mosier |
| 5,498,880 | A | 3/1996 | Lee et al. |
| 5,572,444 | A | 11/1996 | Lentz et al. |
| 5,589,847 | A | 12/1996 | Lewis |
| 5,619,033 | A | 4/1997 | Weisfield |
| 5,648,276 | A | 7/1997 | Hara et al. |
| 5,670,973 | A | 9/1997 | Bassetti et al. |
| 5,691,783 | A | 11/1997 | Numao et al. |
| 5,701,505 | A | 12/1997 | Yamashita et al. |
| 5,714,968 | A | 2/1998 | Ikeda |
| 5,723,950 | A | 3/1998 | Wei et al. |
| 5,744,824 | A | 4/1998 | Kousai et al. |
| 5,745,660 | A | 4/1998 | Kolpatzik et al. |
| 5,748,160 | A | 5/1998 | Shieh et al. |
| 5,758,129 | A | 5/1998 | Gray et al. |
| 5,815,303 | A | 9/1998 | Berlin |
| 5,835,376 | A | 11/1998 | Smith et al. |
| 5,870,071 | A | 2/1999 | Kawahata |
| 5,874,803 | A | 2/1999 | Garbuzov et al. |
| 5,880,582 | A | 3/1999 | Sawada |
| 5,903,248 | A | 5/1999 | Irwin |
| 5,917,280 | A | 6/1999 | Burrows et al. |
| 5,923,794 | A | 7/1999 | McGrath et al. |
| 5,945,972 | A | 8/1999 | Okumura et al. |
| 5,949,398 | A | 9/1999 | Kim |
| 5,952,789 | A | 9/1999 | Stewart et al. |
| 5,952,991 | A | 9/1999 | Akiyama et al. |
| 5,982,104 | A | 11/1999 | Sasaki et al. |
| 5,990,629 | A | 11/1999 | Yamada et al. |
| 6,023,259 | A | 2/2000 | Howard et al. |
| 6,069,365 | A | 5/2000 | Chow et al. |
| 6,091,203 | A | 7/2000 | Kawashima et al. |
| 6,097,360 | A | 8/2000 | Holloman |
| 6,100,868 | A | 8/2000 | Lee et al. |
| 6,144,222 | A | 11/2000 | Ho |
| 6,177,915 | B1 | 1/2001 | Beeteson et al. |
| 6,229,506 | B1 | 5/2001 | Dawson et al. |
| 6,229,508 | B1 | 5/2001 | Kane |
| 6,246,180 | B1 | 6/2001 | Nishigaki |
| 6,252,248 | B1 | 6/2001 | Sano et al. |
| 6,259,424 | B1 | 7/2001 | Kurogane |
| 6,262,589 | B1 | 7/2001 | Tamukai |
| 6,268,841 | B1 | 7/2001 | Cairns et al. |
| 6,271,825 | B1 | 8/2001 | Greene et al. |
| 6,288,696 | B1 | 9/2001 | Holloman |
| 6,304,039 | B1 | 10/2001 | Appelberg et al. |
| 6,307,322 | B1 | 10/2001 | Dawson et al. |
| 6,310,962 | B1 | 10/2001 | Chung et al. |
| 6,320,325 | B1 | 11/2001 | Cok et al. |
| 6,323,631 | B1 | 11/2001 | Juang |
| 6,333,729 | B1 | 12/2001 | Ha |
| 6,356,029 | B1 | 3/2002 | Hunter |
| 6,373,454 | B1 | 4/2002 | Knapp et al. |
| 6,388,653 | B1 | 5/2002 | Goto et al. |
| 6,392,617 | B1 | 5/2002 | Gleason |
| 6,396,469 | B1 | 5/2002 | Miwa et al. |
| 6,414,661 | B1 | 7/2002 | Shen et al. |
| 6,417,825 | B1 | 7/2002 | Stewart et al. |
| 6,430,496 | B1 | 8/2002 | Smith et al. |
| 6,433,488 | B1 | 8/2002 | Bu |
| 6,437,106 | B1 | 8/2002 | Stoner et al. |
| 6,445,369 | B1 | 9/2002 | Yang et al. |
| 6,473,065 | B1 | 10/2002 | Fan |
| 6,475,845 | B2 | 11/2002 | Kimura |
| 6,501,098 | B2 | 12/2002 | Yamazaki |
| 6,501,466 | B1 | 12/2002 | Yamagishi et al. |
| 6,522,315 | B2 | 2/2003 | Ozawa et al. |
| 6,525,683 | B1 | 2/2003 | Gu |
| 6,531,827 | B2 | 3/2003 | Kawashima |
| 6,535,185 | B2 | 3/2003 | Kim et al. |
| 6,542,138 | B1 | 4/2003 | Shannon et al. |
| 6,580,408 | B1 | 6/2003 | Bae et al. |
| 6,580,657 | B2 | 6/2003 | Sanford et al. |
| 6,583,398 | B2 | 6/2003 | Harkin |
| 6,583,775 | B1 | 6/2003 | Sekiya et al. |
| 6,594,606 | B2 | 7/2003 | Everitt |
| 6,618,030 | B2 | 9/2003 | Kane et al. |
| 6,639,244 | B1 | 10/2003 | Yamazaki et al. |
| 6,668,645 | B1 | 12/2003 | Gilmour et al. |
| 6,677,713 | B1 | 1/2004 | Sung |
| 6,680,580 | B1 | 1/2004 | Sung |
| 6,686,699 | B2 | 2/2004 | Yumoto |
| 6,687,266 | B1 | 2/2004 | Ma et al. |
| 6,690,000 | B1 | 2/2004 | Muramatsu et al. |
| 6,690,344 | B1 | 2/2004 | Takeuchi et al. |
| 6,693,388 | B2 | 2/2004 | Oomura |
| 6,693,610 | B2 | 2/2004 | Shannon et al. |
| 6,694,248 | B2 | 2/2004 | Smith et al. |
| 6,697,057 | B2 | 2/2004 | Koyama et al. |
| 6,720,942 | B2 | 4/2004 | Lee et al. |
| 6,724,151 | B2 | 4/2004 | Yoo |
| 6,734,636 | B2 | 5/2004 | Sanford et al. |
| 6,738,034 | B2 | 5/2004 | Kaneko et al. |
| 6,738,035 | B1 | 5/2004 | Fan |
| 6,753,655 | B2 | 6/2004 | Shih et al. |
| 6,753,834 | B2 | 6/2004 | Mikami et al. |
| 6,756,741 | B2 | 6/2004 | Li |
| 6,756,952 | B1 | 6/2004 | Decaux et al. |
| 6,756,958 | B2 | 6/2004 | Furuhashi et al. |
| 6,771,028 | B1 | 8/2004 | Winters |
| 6,777,712 | B2 | 8/2004 | Sanford et al. |
| 6,777,888 | B2 | 8/2004 | Kondo |
| 6,781,567 | B2 | 8/2004 | Kimura |
| 6,788,231 | B1 | 9/2004 | Hsueh |
| 6,806,497 | B2 | 10/2004 | Jo |
| 6,806,638 | B2 | 10/2004 | Lih et al. |
| 6,806,857 | B2 | 10/2004 | Sempel et al. |
| 6,809,706 | B2 | 10/2004 | Shimoda |
| 6,815,975 | B2 | 11/2004 | Nara et al. |
| 6,828,950 | B2 | 12/2004 | Koyama |
| 6,853,371 | B2 | 2/2005 | Miyajima et al. |
| 6,858,991 | B2 | 2/2005 | Miyazawa |
| 6,859,193 | B1 | 2/2005 | Yumoto |
| 6,873,117 | B2 | 3/2005 | Ishizuka |
| 6,876,346 | B2 | 4/2005 | Anzai et al. |
| 6,885,356 | B2 | 4/2005 | Hashimoto |
| 6,900,485 | B2 | 5/2005 | Lee |
| 6,903,734 | B2 | 6/2005 | Eu |
| 6,909,243 | B2 | 6/2005 | Inukai |
| 6,909,419 | B2 | 6/2005 | Zavracky et al. |
| 6,911,960 | B1 | 6/2005 | Yokoyama |
| 6,911,964 | B2 | 6/2005 | Lee et al. |
| 6,914,448 | B2 | 7/2005 | Jinno |
| 6,919,871 | B2 | 7/2005 | Kwon |
| 6,924,602 | B2 | 8/2005 | Komiya |
| 6,937,215 | B2 | 8/2005 | Lo |
| 6,937,220 | B2 | 8/2005 | Kitaura et al. |
| 6,940,214 | B1 | 9/2005 | Komiya et al. |
| 6,943,500 | B2 | 9/2005 | LeChevalier |
| 6,947,022 | B2 | 9/2005 | McCartney |
| 6,954,194 | B2 | 10/2005 | Matsumoto et al. |
| 6,956,547 | B2 | 10/2005 | Bae et al. |
| 6,970,149 | B2 | 11/2005 | Chung et al. |

(56) References Cited

U.S. PATENT DOCUMENTS 6,975,142 B2 12/2005 Azami et al.
6,975,332 B2 12/2005 Arnold et al.
6,995,510 B2 2/2006 Murakami et al.
6,995,519 B2 2/2006 Arnold et al.
7,023,408 B2 4/2006 Chen et al.
7,027,015 B2 4/2006 Booth, Jr. et al.
7,027,078 B2 4/2006 Reihl
7,034,793 B2 4/2006 Sekiya et al.
7,038,392 B2 5/2006 Libsch et al.
7,057,359 B2 6/2006 Hung et al.
7,057,588 B2 6/2006 Asano et al.
7,061,451 B2 6/2006 Kimura
7,064,733 B2 6/2006 Cok et al.
7,071,932 B2 7/2006 Libsch et al.
7,088,051 B1 8/2006 Cok
7,088,052 B2 8/2006 Kimura
7,102,378 B2 9/2006 Kuo et al.
7,106,285 B2 9/2006 Naugler
7,112,820 B2 9/2006 Change et al.
7,113,864 B2 9/2006 Smith et al.
7,116,058 B2 10/2006 Lo et al.
7,119,493 B2 10/2006 Fryer et al.
7,122,835 B1 10/2006 Ikeda et al.
7,127,380 B1 10/2006 Iverson et al.
7,129,914 B2 10/2006 Knapp et al.
7,164,417 B2 1/2007 Cok
7,193,589 B2 3/2007 Yoshida et al.
7,224,332 B2 5/2007 Cok
7,227,519 B1 6/2007 Kawase et al.
7,245,277 B2 7/2007 Ishizuka
7,248,236 B2 7/2007 Nathan et al.
7,259,737 B2 8/2007 Ono et al.
7,262,753 B2 8/2007 Tanghe et al.
7,274,363 B2 9/2007 Ishizuka et al.
7,310,092 B2 12/2007 Imamura
7,315,295 B2 1/2008 Kimura
7,317,434 B2 1/2008 Lan et al.
7,321,348 B2 1/2008 Cok et al.
7,327,357 B2 2/2008 Jeong
7,333,077 B2 2/2008 Koyama et al.
7,339,560 B2 3/2008 Sun
7,343,243 B2 3/2008 Smith et al.
7,355,574 B1 4/2008 Leon et al.
7,358,941 B2 4/2008 Ono et al.
7,368,868 B2 5/2008 Sakamoto
7,411,571 B2 8/2008 Huh
7,414,600 B2 8/2008 Nathan et al.
7,423,617 B2 9/2008 Giraldo et al.
7,466,166 B2 12/2008 Date et al.
7,474,285 B2 1/2009 Kimura
7,495,501 B2 2/2009 Iwabuchi et al.
7,502,000 B2 3/2009 Yuki et al.
7,515,124 B2 4/2009 Yaguma et al.
7,528,812 B2 5/2009 Tsuge et al.
7,535,449 B2 5/2009 Miyazawa
7,554,512 B2 6/2009 Steer
7,569,849 B2 8/2009 Nathan et al.
7,576,718 B2 8/2009 Miyazawa
7,580,012 B2 8/2009 Kim et al.
7,589,707 B2 9/2009 Chou
7,595,776 B2 9/2009 Hashimoto et al.
7,604,718 B2 10/2009 Zhang et al.
7,609,239 B2 10/2009 Chang
7,612,745 B2 11/2009 Yumoto et al.
7,619,594 B2 11/2009 Hu
7,619,597 B2 11/2009 Nathan et al.
7,633,470 B2 12/2009 Kane
7,639,211 B2 12/2009 Miyazawa
7,656,370 B2 2/2010 Schneider et al.
7,683,899 B2 3/2010 Hirakata et al.
7,688,289 B2 3/2010 Abe et al.
7,760,162 B2 7/2010 Miyazawa
7,800,558 B2 9/2010 Routley et al.
7,808,008 B2 10/2010 Miyake
7,847,764 B2 12/2010 Cok et al.
7,859,492 B2 12/2010 Kohno
7,859,520 B2 12/2010 Kimura
7,868,859 B2 1/2011 Tomida et al.
7,876,294 B2 1/2011 Sasaki et al.
7,889,159 B2 2/2011 Nathan et al.
7,903,127 B2 3/2011 Kwon
7,920,116 B2 4/2011 Woo et al.
7,924,249 B2 4/2011 Nathan et al.
7,932,883 B2 4/2011 Klompenhouwer et al.
7,944,414 B2 5/2011 Shirasaki et al.
7,969,390 B2 6/2011 Yoshida
7,978,170 B2 7/2011 Park et al.
7,978,187 B2 7/2011 Nathan et al.
7,989,392 B2 8/2011 Crockett et al.
7,994,712 B2 8/2011 Sung et al.
7,995,008 B2 8/2011 Miwa
8,026,876 B2 9/2011 Nathan et al.
8,049,420 B2 11/2011 Tamura et al.
8,063,852 B2 11/2011 Kwak et al.
8,077,123 B2 12/2011 Naugler, Jr.
8,115,707 B2 2/2012 Nathan et al.
8,144,081 B2 3/2012 Miyazawa
8,159,007 B2 4/2012 Bama et al.
8,223,177 B2 7/2012 Nathan et al.
8,232,939 B2 7/2012 Nathan et al.
8,242,979 B2 8/2012 Anzai et al.
8,259,044 B2 9/2012 Nathan et al.
8,264,431 B2 9/2012 Bulovic et al.
8,279,143 B2 10/2012 Nathan et al.
8,319,712 B2 11/2012 Nathan et al.
8,339,386 B2 12/2012 Leon et al.
2001/0002703 A1 6/2001 Koyama
2001/0009283 A1 7/2001 Arao et al.
2001/0024181 A1 9/2001 Kubota
2001/0024186 A1 9/2001 Kane et al.
2001/0026257 A1 10/2001 Kimura
2001/0030323 A1 10/2001 Ikeda
2001/0040541 A1 11/2001 Yoneda et al.
2001/0043173 A1 11/2001 Troutman
2001/0045929 A1 11/2001 Prache
2001/0052606 A1 12/2001 Sempel et al.
2001/0052940 A1 12/2001 Hagihara et al.
2002/0000576 A1 1/2002 Inukai
2002/0011796 A1 1/2002 Koyama
2002/0011799 A1 1/2002 Kimura
2002/0012057 A1 1/2002 Kimura
2002/0014851 A1 2/2002 Tai et al.
2002/0018034 A1 2/2002 Ohki et al.
2002/0030190 A1 3/2002 Ohtani et al.
2002/0047565 A1 4/2002 Nara et al.
2002/0052086 A1 5/2002 Maeda
2002/0067134 A1 6/2002 Kawashima
2002/0080108 A1 6/2002 Wang
2002/0084463 A1 7/2002 Sanford et al.
2002/0101172 A1 8/2002 Bu
2002/0105279 A1 8/2002 Kimura
2002/0117722 A1 8/2002 Osada et al.
2002/0122308 A1 9/2002 Ikeda
2002/0140712 A1 10/2002 Ouchi et al.
2002/0158587 A1 10/2002 Komiya
2002/0158666 A1 10/2002 Azami et al.
2002/0158823 A1 10/2002 Zavracky et al.
2002/0167474 A1 11/2002 Everitt
2002/0171613 A1 11/2002 Goto et al.
2002/0180369 A1 12/2002 Koyama
2002/0180721 A1 12/2002 Kimura et al.
2002/0186214 A1 12/2002 Siwinski
2002/0190924 A1 12/2002 Asano et al.
2002/0190971 A1 12/2002 Nakamura et al.
2002/0195967 A1 12/2002 Kim et al.
2002/0195968 A1 12/2002 Sanford et al.
2003/0001828 A1 1/2003 Asano
2003/0020413 A1 1/2003 Oomura
2003/0030603 A1 2/2003 Shimoda
2003/0043088 A1 3/2003 Booth et al.
2003/0057895 A1 3/2003 Kimura
2003/0058226 A1 3/2003 Bertram et al.
2003/0062524 A1 4/2003 Kimura
2003/0062844 A1 4/2003 Miyazawa

(56) References Cited

U.S. PATENT DOCUMENTS

2003/0063081 A1 4/2003 Kimura et al.
2003/0071821 A1 4/2003 Sundahl et al.
2003/0076048 A1 4/2003 Rutherford
2003/0090445 A1 5/2003 Chen et al.
2003/0090447 A1 5/2003 Kimura
2003/0090481 A1 5/2003 Kimura
2003/0095087 A1 5/2003 Libsch
2003/0098829 A1 5/2003 Chen et al.
2003/0107560 A1 6/2003 Yumoto et al.
2003/0107561 A1 6/2003 Uchino et al.
2003/0111966 A1 6/2003 Mikami et al.
2003/0112205 A1 6/2003 Yamada
2003/0112208 A1 6/2003 Okabe et al.
2003/0112231 A1* 6/2003 Kurumisawa ..... G09G 3/3233 345/212
2003/0117348 A1 6/2003 Knapp et al.
2003/0122474 A1 7/2003 Lee
2003/0122745 A1 7/2003 Miyazawa
2003/0122747 A1 7/2003 Shannon et al.
2003/0122813 A1 7/2003 Ishizuki et al.
2003/0128199 A1 7/2003 Kimura
2003/0142088 A1 7/2003 LeChevalier
2003/0151569 A1 8/2003 Lee et al.
2003/0156101 A1 8/2003 Le Chevalier
2003/0156104 A1 8/2003 Morita
2003/0169241 A1 9/2003 LeChevalier
2003/0169247 A1 9/2003 Kawabe et al.
2003/0174152 A1 9/2003 Noguchi
2003/0179626 A1 9/2003 Sanford et al.
2003/0189535 A1 10/2003 Matsumoto et al.
2003/0197663 A1 10/2003 Lee et al.
2003/0210256 A1 11/2003 Mori et al.
2003/0214465 A1 11/2003 Kimura
2003/0230141 A1 12/2003 Gilmour et al.
2003/0230980 A1 12/2003 Forrest et al.
2003/0231148 A1 12/2003 Lin et al.
2004/0004589 A1 1/2004 Shih
2004/0032382 A1 2/2004 Cok et al.
2004/0041750 A1 3/2004 Abe
2004/0066357 A1 4/2004 Kawasaki
2004/0070557 A1 4/2004 Asano et al.
2004/0070565 A1 4/2004 Nayar et al.
2004/0090186 A1 5/2004 Kanauchi et al.
2004/0090400 A1 5/2004 Yoo
2004/0095297 A1 5/2004 Libsch et al.
2004/0100427 A1 5/2004 Miyazawa
2004/0108518 A1 6/2004 Jo
2004/0129933 A1 7/2004 Nathan et al.
2004/0130516 A1 7/2004 Nathan et al.
2004/0135749 A1 7/2004 Kondakov et al.
2004/0145547 A1 7/2004 Oh
2004/0150592 A1 8/2004 Mizukoshi et al.
2004/0150594 A1 8/2004 Koyama et al.
2004/0150595 A1 8/2004 Kasai
2004/0155841 A1 8/2004 Kasai
2004/0171619 A1 9/2004 Barkoczy et al.
2004/0174347 A1 9/2004 Sun et al.
2004/0174349 A1 9/2004 Libsch
2004/0174354 A1 9/2004 Ono et al.
2004/0178743 A1 9/2004 Miller et al.
2004/0183759 A1 9/2004 Stevenson et al.
2004/0189627 A1 9/2004 Shirasaki et al.
2004/0196275 A1 10/2004 Hattori
2004/0207615 A1 10/2004 Yumoto
2004/0239596 A1 12/2004 Ono et al.
2004/0239696 A1 12/2004 Okabe
2004/0251844 A1 12/2004 Hashido et al.
2004/0252085 A1 12/2004 Miyagawa
2004/0252089 A1 12/2004 Ono et al.
2004/0256617 A1 12/2004 Yamada et al.
2004/0257313 A1 12/2004 Kawashima et al.
2004/0257353 A1 12/2004 Imamura et al.
2004/0257355 A1 12/2004 Naugler
2004/0263437 A1 12/2004 Hattori
2004/0263444 A1 12/2004 Kimura
2004/0263445 A1 12/2004 Inukai et al.
2004/0263541 A1 12/2004 Takeuchi et al.
2005/0007355 A1 1/2005 Miura
2005/0007357 A1 1/2005 Yamashita et al.
2005/0017650 A1 1/2005 Fryer et al.
2005/0024081 A1 2/2005 Kuo et al.
2005/0024393 A1 2/2005 Kondo et al.
2005/0030267 A1 2/2005 Tanghe et al.
2005/0052379 A1 3/2005 Waterman
2005/0057459 A1 3/2005 Miyazawa
2005/0057580 A1 3/2005 Yamano et al.
2005/0067970 A1 3/2005 Libsch et al.
2005/0067971 A1 3/2005 Kane
2005/0068270 A1 3/2005 Awakura
2005/0068275 A1 3/2005 Kane
2005/0073264 A1 4/2005 Matsumoto
2005/0083270 A1 4/2005 Miyazawa
2005/0083323 A1 4/2005 Suzuki et al.
2005/0088103 A1 4/2005 Kageyama et al.
2005/0110420 A1 5/2005 Arnold et al.
2005/0110727 A1 5/2005 Shin
2005/0110807 A1 5/2005 Chang
2005/0123193 A1 6/2005 Lamberg et al.
2005/0140598 A1 6/2005 Kim et al.
2005/0140610 A1 6/2005 Smith et al.
2005/0145891 A1 7/2005 Abe
2005/0156831 A1 7/2005 Yamazaki et al.
2005/0168416 A1 8/2005 Hashimoto et al.
2005/0179626 A1 8/2005 Yuki et al.
2005/0179628 A1 8/2005 Kimura
2005/0185200 A1 8/2005 Tobol
2005/0200575 A1 9/2005 Kim et al.
2005/0206590 A1 9/2005 Sasaki et al.
2005/0219184 A1 10/2005 Zehner et al.
2005/0219188 A1 10/2005 Kawabe et al.
2005/0243037 A1 11/2005 Eom et al.
2005/0248515 A1 11/2005 Naugler et al.
2005/0258867 A1 11/2005 Miyazawa
2005/0269959 A1 12/2005 Uchino et al.
2005/0269960 A1 12/2005 Ono et al.
2005/0280615 A1 12/2005 Cok et al.
2005/0280766 A1 12/2005 Johnson et al.
2005/0285822 A1 12/2005 Reddy et al.
2005/0285825 A1 12/2005 Eom et al.
2006/0001613 A1 1/2006 Routley et al.
2006/0007072 A1 1/2006 Choi et al.
2006/0012310 A1 1/2006 Chen et al.
2006/0012311 A1 1/2006 Ogawa
2006/0027807 A1 2/2006 Nathan et al.
2006/0030084 A1 2/2006 Young
2006/0038750 A1 2/2006 Inoue et al.
2006/0038758 A1* 2/2006 Routley et al. ..... 345/81
2006/0038762 A1 2/2006 Chou
2006/0066533 A1 3/2006 Sato et al.
2006/0077077 A1 4/2006 Kwon
2006/0077135 A1 4/2006 Cok et al.
2006/0082523 A1 4/2006 Guo et al.
2006/0092185 A1 5/2006 Jo et al.
2006/0097628 A1 5/2006 Suh et al.
2006/0097631 A1 5/2006 Lee
2006/0103611 A1 5/2006 Choi
2006/0125408 A1 6/2006 Nathan et al.
2006/0139253 A1 6/2006 Choi et al.
2006/0145964 A1 7/2006 Park et al.
2006/0149493 A1 7/2006 Sambandan et al.
2006/0170623 A1 8/2006 Naugler, Jr. et al.
2006/0176250 A1 8/2006 Nathan et al.
2006/0191178 A1 8/2006 Sempel et al.
2006/0208961 A1 9/2006 Nathan et al.
2006/0209012 A1 9/2006 Hagood, IV
2006/0221009 A1 10/2006 Miwa
2006/0227082 A1 10/2006 Ogata et al.
2006/0232522 A1 10/2006 Roy et al.
2006/0244391 A1 11/2006 Shishido et al.
2006/0244697 A1 11/2006 Lee et al.
2006/0261841 A1 11/2006 Fish
2006/0273997 A1 12/2006 Nathan et al.
2006/0284801 A1 12/2006 Yoon et al.
2006/0284895 A1 12/2006 Marcu et al.

(56) References Cited

U.S. PATENT DOCUMENTS

2006/0290614 A1 12/2006 Nathan et al.
2006/0290618 A1 12/2006 Goto
2007/0001937 A1 1/2007 Park et al.
2007/0001939 A1 1/2007 Hashimoto et al.
2007/0001945 A1 1/2007 Yoshida et al.
2007/0008268 A1 1/2007 Park et al.
2007/0008297 A1* 1/2007 Bassetti ..... 345/173
2007/0035489 A1 2/2007 Lee
2007/0035707 A1 2/2007 Margulis
2007/0040773 A1 2/2007 Lee et al.
2007/0057873 A1 3/2007 Uchino et al.
2007/0063932 A1 3/2007 Nathan et al.
2007/0069998 A1 3/2007 Naugler et al.
2007/0075727 A1 4/2007 Nakano et al.
2007/0076226 A1 4/2007 Klompenhouwer et al.
2007/0080905 A1 4/2007 Takahara
2007/0080906 A1 4/2007 Tanabe
2007/0080908 A1 4/2007 Nathan et al.
2007/0085801 A1 4/2007 Park et al.
2007/0097038 A1 5/2007 Yamazaki et al.
2007/0097041 A1 5/2007 Park et al.
2007/0103419 A1 5/2007 Uchino et al.
2007/0109232 A1 5/2007 Yamamoto et al.
2007/0115221 A1 5/2007 Buchhauser et al.
2007/0128583 A1 6/2007 Miyazawa
2007/0164941 A1 7/2007 Park et al.
2007/0182671 A1 8/2007 Nathan et al.
2007/0236430 A1 10/2007 Fish
2007/0236517 A1 10/2007 Kimpe
2007/0241999 A1 10/2007 Lin
2007/0242008 A1 10/2007 Cummings
2007/0273294 A1 11/2007 Nagayama
2007/0285359 A1 12/2007 Ono
2007/0290958 A1 12/2007 Cok
2007/0296672 A1 12/2007 Kim et al.
2008/0001525 A1 1/2008 Chao et al.
2008/0001544 A1 1/2008 Murakami et al.
2008/0036708 A1 2/2008 Shirasaki
2008/0042942 A1 2/2008 Takahashi
2008/0042948 A1 2/2008 Yamashita et al.
2008/0043044 A1 2/2008 Woo et al.
2008/0048951 A1 2/2008 Naugler, Jr. et al.
2008/0055134 A1 3/2008 Li et al.
2008/0055209 A1 3/2008 Cok
2008/0074360 A1 3/2008 Lu et al.
2008/0074413 A1 3/2008 Ogura
2008/0088549 A1 4/2008 Nathan et al.
2008/0088648 A1 4/2008 Nathan et al.
2008/0094426 A1 4/2008 Kimpe
2008/0117144 A1 5/2008 Nakano et al.
2008/0122819 A1 5/2008 Cho et al.
2008/0150847 A1 6/2008 Kim et al.
2008/0228562 A1 9/2008 Smith et al.
2008/0231558 A1 9/2008 Naugler
2008/0231562 A1 9/2008 Kwon
2008/0231641 A1 9/2008 Miyashita
2008/0252571 A1 10/2008 Hente et al.
2008/0290805 A1 11/2008 Yamada et al.
2008/0297055 A1 12/2008 Miyake et al.
2009/0009459 A1 1/2009 Miyashita
2009/0015532 A1 1/2009 Katayama et al.
2009/0058772 A1 3/2009 Lee
2009/0121988 A1 5/2009 Amo et al.
2009/0146926 A1 6/2009 Sung et al.
2009/0153459 A9 6/2009 Han et al.
2009/0160743 A1 6/2009 Tomida et al.
2009/0174628 A1 7/2009 Wang et al.
2009/0184901 A1 7/2009 Kwon
2009/0195483 A1 8/2009 Naugler, Jr. et al.
2009/0201281 A1 8/2009 Routley et al.
2009/0213046 A1 8/2009 Nam
2009/0251486 A1 10/2009 Sakakibara et al.
2009/0278777 A1 11/2009 Wang et al.
2010/0004891 A1 1/2010 Ahlers et al.
2010/0026725 A1 2/2010 Smith
2010/0039451 A1 2/2010 Jung
2010/0039453 A1 2/2010 Nathan et al.
2010/0060911 A1 3/2010 Marcu et al.
2010/0165002 A1 7/2010 Ahn
2010/0194670 A1 8/2010 Cok
2010/0207920 A1 8/2010 Chaji et al.
2010/0207960 A1 8/2010 Kimpe et al.
2010/0225634 A1 9/2010 Levey et al.
2010/0251295 A1* 9/2010 Amento et al. ..... 725/38
2010/0269889 A1 10/2010 Reinhold et al.
2010/0277400 A1 11/2010 Jeong
2010/0315319 A1 12/2010 Cok et al.
2011/0069051 A1 3/2011 Nakamura et al.
2011/0069089 A1 3/2011 Kopf et al.
2011/0074750 A1 3/2011 Leon et al.
2011/0149166 A1 6/2011 Botzas et al.
2011/0227964 A1 9/2011 Chaji et al.
2011/0293480 A1 12/2011 Mueller
2012/0019506 A1* 1/2012 Hekstra et al. ..... 345/212
2012/0056558 A1 3/2012 Toshiya et al.
2012/0062565 A1 3/2012 Fuchs et al.
2012/0299978 A1 11/2012 Chaji
2013/0027381 A1 1/2013 Nathan et al.
2013/0057595 A1 3/2013 Nathan et al.

FOREIGN PATENT DOCUMENTS

CA 1 294 034 1/1992
CA 2 109 951 11/1992
CA 2 249 592 7/1998
CA 2 303 302 3/1999
CA 2 368 386 9/1999
CA 2 242 720 1/2000
CA 2 354 018 6/2000
CA 2 432 530 7/2002
CA 2 436 451 8/2002
CA 2 438 577 8/2002
CA 2 507 276 8/2002
CA 2 463 653 1/2004
CA 2 498 136 3/2004
CA 2 522 396 11/2004
CA 2 438 363 2/2005
CA 2 443 206 3/2005
CA 2 519 097 3/2005
CA 2 472 671 12/2005
CA 2 523 841 1/2006
CA 2 567 076 1/2006
CA 2 526 782 4/2006
CA 2 495 726 7/2006
CA 2 557 713 11/2006
CA 2 651 893 A1 11/2007
CA 2 550 102 4/2008
CA 2 672 590 A1 10/2009
CN 1381032 11/2002
CN 1448908 10/2003
CN 1760945 4/2006
DE 202006007613 U1 9/2006
EP 0 158 366 10/1985
EP 0 478 186 4/1992
EP 1 028 471 A 8/2000
EP 1 111 577 6/2001
EP 1 130 565 A1 9/2001
EP 1 194 013 4/2002
EP 1 321 922 B1 6/2003
EP 1 335 430 A1 8/2003
EP 1 372 136 12/2003
EP 1 381 019 1/2004
EP 1 418 566 5/2004
EP 1 429 312 A 6/2004
EP 1 439 520 A2 7/2004
EP 1 465 143 A 10/2004
EP 1 469 448 A 10/2004
EP 1 473 689 A 11/2004
EP 1 517 290 A2 3/2005
EP 1 521 203 A2 4/2005
EP 1 594 347 11/2005
EP 1 784 055 A2 5/2007
EP 1 879 169 A1 1/2008
EP 1 879 172 1/2008

(56) References Cited

FOREIGN PATENT DOCUMENTS

| | | | |
|---|---|---|---|
| GB | 2 389 951 | | 12/2003 |
| GB | 2 399 935 | A | 9/2004 |
| GB | 2 460 018 | A | 11/2009 |
| JP | 1272298 | | 10/1989 |
| JP | 4-042619 | | 2/1992 |
| JP | 6-314977 | | 11/1994 |
| JP | 8-340243 | | 12/1996 |
| JP | 09-090405 | | 4/1997 |
| JP | 10-254410 | | 9/1998 |
| JP | 11-202295 | | 7/1999 |
| JP | 11-219146 | | 8/1999 |
| JP | 11 231805 | | 8/1999 |
| JP | 11-282419 | | 10/1999 |
| JP | 2000-056847 | | 2/2000 |
| JP | 2000-81607 | | 3/2000 |
| JP | 2001-134217 | | 5/2001 |
| JP | 2001-195014 | | 7/2001 |
| JP | 2002-055654 | | 2/2002 |
| JP | 2002-91376 | | 3/2002 |
| JP | 2002-514320 | | 5/2002 |
| JP | 2002-278513 | | 9/2002 |
| JP | 2002-333862 | | 11/2002 |
| JP | 2003-076331 | | 3/2003 |
| JP | 2003-124519 | | 4/2003 |
| JP | 2003-177709 | | 6/2003 |
| JP | 2003-271095 | | 9/2003 |
| JP | 2003-308046 | | 10/2003 |
| JP | 2003-317944 | | 11/2003 |
| JP | 2004-054188 | A | 2/2004 |
| JP | 2004-145197 | | 5/2004 |
| JP | 2004-287345 | | 10/2004 |
| JP | 2005-057217 | | 3/2005 |
| JP | 2005-099715 | | 4/2005 |
| JP | 2005-338819 | | 12/2005 |
| JP | 2007/316356 | A | 12/2007 |
| JP | 2008/083085 | A | 4/2008 |
| JP | 4-158570 | | 10/2008 |
| JP | 2009/522621 | A | 6/2009 |
| KR | 2004-0100887 | | 12/2004 |
| TW | 342486 | | 10/1998 |
| TW | 473622 | | 1/2002 |
| TW | 485337 | | 5/2002 |
| TW | 502233 | | 9/2002 |
| TW | 538650 | | 6/2003 |
| TW | 569173 | B | 1/2004 |
| TW | 1221268 | | 9/2004 |
| TW | 1223092 | | 11/2004 |
| TW | 200526065 | | 8/2005 |
| TW | 1239501 | B | 9/2005 |
| TW | 200727247 | | 7/2007 |
| WO | WO 98/11554 | | 3/1998 |
| WO | WO 98/48403 | | 10/1998 |
| WO | WO 99/48079 | | 9/1999 |
| WO | WO 01/06484 | | 1/2001 |
| WO | WO 01/27910 | A1 | 4/2001 |
| WO | WO 01/63587 | A2 | 8/2001 |
| WO | WO 02/067327 | A | 8/2002 |
| WO | WO 03/001496 | A1 | 1/2003 |
| WO | WO 03/034389 | A2 | 4/2003 |
| WO | WO 03/058594 | A1 | 7/2003 |
| WO | WO 03/063124 | A1 | 7/2003 |
| WO | WO 03/075256 | | 9/2003 |
| WO | WO 03/077231 | | 9/2003 |
| WO | WO 2004/003877 | | 1/2004 |
| WO | WO 2004/015668 | A1 | 2/2004 |
| WO | WO 2004/025615 | A | 3/2004 |
| WO | WO 2004/034364 | | 4/2004 |
| WO | WO 2004/047058 | | 6/2004 |
| WO | WO 2004/104975 | A1 | 12/2004 |
| WO | WO 2005/022498 | | 3/2005 |
| WO | WO 2005/022500 | A | 3/2005 |
| WO | WO 2005/029455 | | 3/2005 |
| WO | WO 2005/029456 | | 3/2005 |
| WO | WO 2005/055185 | | 6/2005 |
| WO | WO 2005/055186 | A1 | 6/2005 |
| WO | WO 2005/069267 | A1 | 7/2005 |
| WO | WO 2005/122121 | A1 | 12/2005 |
| WO | WO 2006/000101 | A1 | 1/2006 |
| WO | WO 2006/053424 | | 5/2006 |
| WO | WO 2006/063448 | A | 6/2006 |
| WO | WO 2006/084360 | | 8/2006 |
| WO | WO 2006/128069 | A2 | 11/2006 |
| WO | WO 2007/003877 | A | 1/2007 |
| WO | WO 2007/079572 | | 7/2007 |
| WO | WO 2007/120849 | A2 | 10/2007 |
| WO | WO 2009/055920 | | 5/2009 |
| WO | WO 2009/059028 | A2 | 5/2009 |
| WO | WO 2009/127065 | A1 | 10/2009 |
| WO | WO 2010/023270 | | 3/2010 |
| WO | WO 2010/066030 | A1 | 6/2010 |
| WO | WO 2010/120733 | A1 | 10/2010 |
| WO | WO 2011/041224 | A1 | 4/2011 |

OTHER PUBLICATIONS

Extended European Search Report mailed Aug. 6, 2013, issued in European Patent Application No. 11739485.8 (14 pages).

Extended European Search Report mailed Jul. 11, 2012 which issued in corresponding European Patent Application No. EP 11191641.7 (14 pages).

Extended European Search Report mailed Nov. 29, 2012, issued in European Patent Application No. EP 11168677.0 (13 page).

Extended European Search Report mailed Nov. 8, 2011 issued in European Patent Application No. 11175223.4 (8 pages).

Extended European Search Report, Application No. 06752777.0, dated Dec. 6, 2010 (21 pages).

Extended European Search Report, Application No. 09732338.0, dated May 24, 2011 (8 pages).

Fan et al. "LTPS_TFT Pixel Circuit Compensation for TFT Threshold Voltage Shift and IR-Drop on the Power Line for Amolded Displays" 5 pages copyright 2012.

Fossum, Eric R.. "Active Pixel Sensors: Are CCD's Dinosaurs?" SPIE: Symposium on Electronic Imaging. Feb. 1, 1993 (13 pages).

Goh et al., "A New a-Si:H Thin-Film Transistor Pixel Circuit for Active-Matrix Organic Light-Emitting Diodes", IEEE Electron Device Letters, Vol, 24, No. 9, Sep. 2003, pp. 583-585.

International Preliminary Report on Patentability for International Application No. PCT/CA2005/001007 dated Oct. 16, 2006, 4 pages.

International Search Report corresponding to co-pending International Patent Application Serial No. PCT/IB2013/054251, Canadian Intellectual Property Office, dated Sep. 11, 2013; (4 pages).

International Search Report corresponding to International Application No. PCT/IB2011/050502, dated Jun. 27, 2011 (6 pages).

International Search Report corresponding to International Application No. PCT/CA2004/001742, Canadian Patent Office, dated Feb. 21, 2005 (2 pages).

International Search Report corresponding to International Application No. PCT/IB2010/055541 filed Dec. 1, 2010, dated May 26, 2011; 5 pages.

International Search Report corresponding to International Application No. PCT/IB2011/055135, Canadian Patent Office, dated Apr. 16, 2012 (5 pages).

Lee, Wonbok: "Thermal Management in Microprocessor Chips and Dynamic Backlight Control in Liquid Crystal Displays", Ph.D. Dissertation, University of Southern California (124 pages).

Ma e y et al: "Organic Light-Emitting Diode/Thin Film Transistor Integration for foldable Displays" Conference record of the 1997 International display research conference and international workshops on LCD technology and emissive technology. Toronto, Sep. 15-19, 1997 (6 pages).

Matsueda y et al.: "35.1: 2.5-in. AMOLED with Integrated 6-bit Gamma Compensated Digital Data Driver"; dated May 2004 (4 pages).

Mendes E., et al. "A High Resolution Switch-Current Memory Base Cell." IEEE: Circuits and Systems. vol. 2, Aug. 1999 (pp. 718-721).

Nathan A. et al., "Thin Film imaging technology on glass and plastic" ICM 2000, proceedings of the 12 international conference on microelectronics, dated Oct. 31, 2001 (4 pages).

(56) References Cited

OTHER PUBLICATIONS

Nathan et al., "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Nathan et al.: "Backplane Requirements for active Matrix Organic Light Emitting Diode Displays,"; dated 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a -Si for AMOLED—Meeting the Performance and Cost Demands of Display Applications (Cell Phone to HDTV)"; dated Jun. 2006 (4 pages).
Office Action in Japanese patent application No. JP2006-527247 dated Mar. 15, 2010. (8 pages).
Office Action in Japanese patent application No. JP2007-545796 dated Sep. 5, 2011. (8 pages).
Ono et al., "Shared Pixel Compensation Circuit for AM-OLED Displays," Proceedings of the 9$^{th}$ Asian Symposium on Information Display (ASID), pp. 462-465, New Delhi, dated Oct. 8-12, 2006 (4 pages).
Partial European Search Report mailed Mar. 20, 2012 which issued in corresponding European Patent Application No. EP 11191641.7 (8 pages).
Partial European Search Report mailed Sep. 22, 2011 corresponding to European Patent Application No. EP 11168677.0 (5 pages).
Philipp: "Charge transfer sensing" Sensor Review, vol. 19, No. 2, Dec. 31, 1999, 10 pages.
Office Action in Japanese Patent Application No. JP2012-542651, dated Jul. 30, 2015 (6 pages).
Ahnood et al.: "Effect of threshold voltage instability on field effect mobility in thin film transistors deduced from constant current measurements"; dated Aug. 2009.
Alexander et al.: "Pixel circuits and drive schemes for glass and elastic AMOLED displays"; dated Jul. 2005 (9 pages).
Alexander et al.: "Unique Electrical Measurement Technology for Compensation, Inspection, and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A Novel Driving Scheme for High Resolution Large-area a-Si:H AMOLED displays"; dated Aug. 2005 (3 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High-Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated 2008 (177 pages).
Chapter 3: Color Spaces"Keith Jack: "Video Demystified:"A Handbook for the Digital Engineer" 2001, Referex ORD-0000-00-00, USA EP040425529, ISBN: 1-878707-56-6, pp. 32-33.
Chapter 8: Alternative Flat Panel Display 1-25 Technologies; Willem den Boer: "Active Matrix Liquid Crystal Display: Fundamentals and Applications" 2005, Referex ORD-0000-00-00 U.K.; XP040426102 ISBN: 0-7506-7813-5, pp. 206-209, p. 208.
European Partial Search Report corresponding to European Patent Application Serial No. 12156251.6, European Patent Office, dated May 30, 2012 (7 pages).
European Patent Office Communication in European Application No. 05821114 dated Jan. 11, 2013 (9 pages).
European Patent Office Communication with Supplemental European Search Report for EP Application No. 07701644.2, dated Aug. 18, 2009 (12 pages).
Extended European Search Report corresponding to Application EP 10175764, dated Oct. 18, 2010 (2 pages).
European Search Report corresponding to European Patent Application Serial No. 12156251.6, European Patent Office, dated Oct. 12, 2012 (18 pages).
European Search Report corresponding to European Patent Application No. 10829593.2, European Patent Office, dated May 17, 2013 (7 pages).
European Search Report for Application No. 11175225.9 dated Nov. 4, 2011 (9 pages).
European Search Report for EP Application No. EP 10166143, dated Sep. 3, 2010 (2 pages).
European Search Report for European Application No. EP 011122313 dated Sep. 14, 2005 (4 pages).
European Search Report for European Application No. EP 04786661 dated Mar. 9, 2009.
European Search Report for European Application No. EP 05 80 7905 dated Apr. 2, 2009 (5 pages).
European Search Report for European Application No. EP 05 82 1114 dated Mar. 27, 2009 (2 pages).

(56) References Cited

OTHER PUBLICATIONS

European Search Report for European Application No. EP 05759141 dated Oct. 30, 2009 (2 pages).
European Search Report for European Application No. EP 05819617 dated Jan. 30, 2009.
European Search Report for European Application No. EP 06 70 5133 dated Jul. 18, 2008.
European Search Report for European Application No. EP 06721798 dated Nov. 12, 2009 (2 pages).
Extended European Search Report for European Application No. EP 07 70 1644 dated Aug. 5, 2009.
European Search Report for European Application No. EP 07710608.6 dated Mar. 19, 2010 (7 pages).
European Search Report for European Application No. EP 07719579 dated May 20, 2009.
European Search Report for European Application No. EP 07815784 dated Jul. 20, 2010 (2 pages).
European Search Report for European Application No. EP 11739485.8-1904 dated Aug. 6, 2013, (14 pages).
European Search Report for European Application No. PCT/CA2006/000177 dated Jun. 2, 2006.
European Search Report, Application No. 10834294.0-1903, dated Apr. 8, 2013 (9 pages).
European Supplementary Search Report corresponding to European Application No. EP 04786662 dated Jan. 19, 2007 (2 pages).
European Supplementary Search Report for EP 09 80 2309, dated May 8, 2011 (14 pages).
European Supplementary Search Report for European Application No. 09831339.8 dated Mar. 26, 2012 (11 pages).
Extended European Search Report corresponding to European Patent Application No. 12174465.0, European Patent Office, dated Sep. 7, 2012 (9 pages).
International Search Report corresponding to International Patent Application No. PCT/IB2010/002898 Canadian Intellectual Property Office, dated Jul. 28, 2009 (5 pages).
International Search Report for Application No. PCT/IB2010/055486, Dated Apr. 19, 2011, 5 pages.
International Search Report for International Application No. PCT/CA2005/001007 dated Oct. 18, 2005.
International Search Report for International Application No. PCT/CA2007/000652 dated Jul. 25, 2007.
International Search Report for International Application No. PCT/CA2004/001741 dated Feb. 21, 2005.
International Search Report for International Application No. PCT/CA2005/001844 dated Mar. 28, 2006 (2 pages).
International Search Report for International Application No. PCT/CA2007/000013 dated May 7, 2007.
International Search Report for International Application No. PCT/CA2006/000941 dated Oct. 3, 2006 (2 pages).
International Search Report for International Application No. PCT/CA2009/001769 dated Apr. 8, 2010.
International Search Report issued in International Application No. PCT/CA2009/001049, mailed Dec. 7, 2009 (4 pages).
International Search Report mailed Dec. 3, 2002, issued in International Patent Application No. PCT/JP02/09668 (4 pages).
International Search Report mailed Jul. 30, 2009 for International Application No. PCT/CA2009/000501 (4 pages).
International Search Report mailed Mar. 21, 2006 issued in International Patent Application No. PCT/CA2005/001897 (2 pages).
International Search Report, International Application PCT/IB2012/052651, 5 pages, dated Sep. 11, 2012.
International Search Report, PCT/IB2011/051103, dated Jul. 8, 2011, 3 pages.
International Search Report, PCT/IB2012/052372, mailed Sep. 12, 2012 (3 pages).
International Searching Authority Search Report, PCT/IB2010/055481, dated Apr. 7, 2011 (3 pages).
International Searching Authority Written Opinion, PCT/IB2010/055481, dated Apr. 7, 2011 (6 pages).
International Written Opinion corresponding to co-pending International Patent Application Serial No. PCT/IB2013/054251, Canadian Intellectual Property Office, dated Sep. 11, 2013; (5 pages).
International Written Opinion corresponding to International Application No. PCT/CA2004/001742, Canadian Patent Office, dated Feb. 21, 2005 (5 pages).
International Written Opinion corresponding to International Application No. PCT/IB2011/055135, Canadian Patent Office, dated Apr. 16, 2012 (5 pages).
International Written Opinion for Application No. PCT/IB2010/055486, Dated Apr. 19, 2011, 8 pages.
International Written Opinion for International Application No. PCT/CA2009/000501 mailed Jul. 30, 2009 (6 pages).
International Written Opinion mailed Mar. 21, 2006 corresponding to International Patent Application No. PCT/CA2005/001897 (4 pages).
International Written Opinion of the International Searching Authority corresponding to International Application No. PCT/IB2011/050502, dated Jun. 27, 2011 (7 pages).
International Written Opinion of the International Searching Authority corresponding to International Application No. PCT/IB2010/055541, dated May 26, 2011; 6 pages.
International Written Opinion, International Application PCT/IB2012/052651, 6 pages, dated Sep. 11, 2012.
International Written Opinion, PCT/IB2011/051103, dated Jul. 8, 2011, 6 pages.
International Written Opinion, PCT/IB2012/052372, mailed Sep. 12, 2012 (6 pages).
Jafarabadiashtiani et al.: "A New Driving Method for a-Si AMOLED Displays Based on Voltage Feedback"; dated 2005 (4 pages).
Kanicki, J., et al. "Amorphous Silicon Thin-Film Transistors Based Active-Matrix Organic Light-Emitting Displays." Asia Display: International Display Workshops, Sep. 2001 (pp. 315-318).
Karim, K. S., et al. "Amorphous Silicon Active Pixel Sensor Readout Circuit for Digital Imaging." IEEE: Transactions on Electron Devices. vol. 50, No. 1, Jan. 2003 (pp. 200-208).
Lee et al.: "Ambipolar Thin-Film Transistors Fabricated by PECVD Nanocrystalline Silicon"; dated May 2006 (6 pages).
Rafati et al.: "Comparison of a 17 b multiplier in Dual-rail domino and in Dual-rail D L (D L) logic styles"; dated 2002 (4 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Safavian et al.: "Three-TFT image sensor for real-time digital X-ray imaging"; dated Feb. 2, 2006 (2 pages).
Search Report for Taiwan Invention Patent Application No. 093128894 dated May 1, 2012. (1 page).
Search Report for Taiwan Invention Patent Application No. 94144535 dated Nov. 1, 2012. (1 page).
Spindler et al., System Considerations for RGBW OLED Displays, Journal of the SID 14/1, 2006, pp. 37-48.
Stewart M. et al., "Polysilicon TFT technology for active matrix OLED displays" IEEE transactions on electron devices, vol. 48, No. 5 May 2001 (7 pages).
Vygranenko et al.: "Stability of indium-oxide thin-film transistors by reactive ion beam assisted deposition"; dated 2009.
Wang et al.: "Indium oxides by reactive ion beam assisted evaporation: From material study to device application"; dated Mar. 2009 (6 pages).

(56) References Cited

OTHER PUBLICATIONS

Written Opinion corresponding to International Patent Application No. PCT/IB2010/002898, Canadian Intellectual Property Office, dated Mar. 30, 2011 (8 pages).
Written Opinion for International Application No. PCT/CA2009/001769 dated Apr. 8, 2010 (8 pages).
Yi He et al., "Current-Source a-Si:H Thin Film Transistor Circuit for Active-Matrix Organic Light-Emitting Displays", IEEE Electron Device Letters, vol. 21, No. 12, Dec. 2000, pp. 590-592.
Yu, Jennifer: "Improve OLED Technology for Display", Ph.D. Dissertation, Massachusetts Institute of Technology, Sep. 2008 (151 pages).

* cited by examiner

SYSTEM AND METHODS FOR POWER CONSERVATION FOR AMOLED PIXEL DRIVERS

CROSS-REFERENCE TO RELATED APPLICATION

This application is a continuation-in-part of, and claims priority to, pending U.S. patent application Ser. No. 12/958,938, filed Dec. 2, 2010, entitled "Systems and Methods for Power Conservation for AMOLED Pixel Drivers," which in turn claims the benefit of Canadian Patent Application Serial No. 2,687,631, filed Dec. 6, 2009, entitled "Low Power Driving Scheme For Display Applications," which are incorporated herein by reference in their entirety.

FIELD OF THE INVENTION

The present invention generally relates to AMOLED displays, and particularly conserving power consumption on such displays for certain high brightness conditions.

BACKGROUND

Currently, active matrix organic light emitting device ("AMOLED) displays are being proposed. The advantages of such displays include lower power consumption, manufacturing flexibility and faster refresh rate. In contrast to conventional LCD displays, there is no backlighting in an AMOLED display, and each pixel consists of different OLEDs, emitting light independently. The power consumed in each pixel has a relation with the magnitude of the generated light in that pixel. A typical pixel includes the organic light emitting device and a thin film drive transistor. A programming voltage is applied to the gate of the drive transistor which is roughly proportional to the current flowing through the drive transistor to the light emitting device. However, the use of current makes the performance of the pixel dependent on the drive transistor whose characteristics may change since many such transistors are currently fabricated from amorphous silicon. For example, the threshold voltage of amorphous silicon transistors may shift over long term use resulting in data from the programming voltage being incorrectly applied due to the shift.

While the active matrix organic light emitting diode (AMOLED) display is well-known for its low average power consumption, power consumption may still be higher than an active matrix liquid crystal display (AMLCD) at peak brightness. This makes an AMOLED display less appealing for applications such as emails, web surfing and eBooks due to the largely white (high brightness) background required to display such applications. The power dissipation in the AMOLED display is governed by that associated with the thin film drive transistor and the OLED itself. Although the development of a higher efficiency OLED continues to significantly lower the power consumption of the display, the power consumption of current OLED displays in applications requiring high brightness are greater than a comparable AMLCD. New approaches in TFT operation are therefore needed for further reduction in power. Thus a method to reduce power consumption to compensate for increased power requirements in certain brightness conditions is needed.

SUMMARY

Aspects of the present disclosure include a current-biased, voltage-programmed circuit for a pixel of a display. The circuit includes a controllable supply voltage source outputting a supply voltage. An organic light emitting device emitting light has a brightness level as a function of current flow. A drive transistor has a drain coupled to the controllable supply voltage source and a source coupled to the organic light emitting device. The drive transistor has a gate input controlled by a programming voltage input to determine the current flow through the light emitting device. To conserve energy, the system monitors the content of a selected segment of the display, sets the supply voltage to the minimum supply voltage required for the current content of the selected segment of the display, determines whether the number of pixels requiring a supply voltage larger than the set value is greater than a predetermined threshold number, and, when the answer is negative, reduces the supply voltage by a predetermined step amount.

The foregoing and additional aspects and embodiments of the present invention will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

Figure 1:
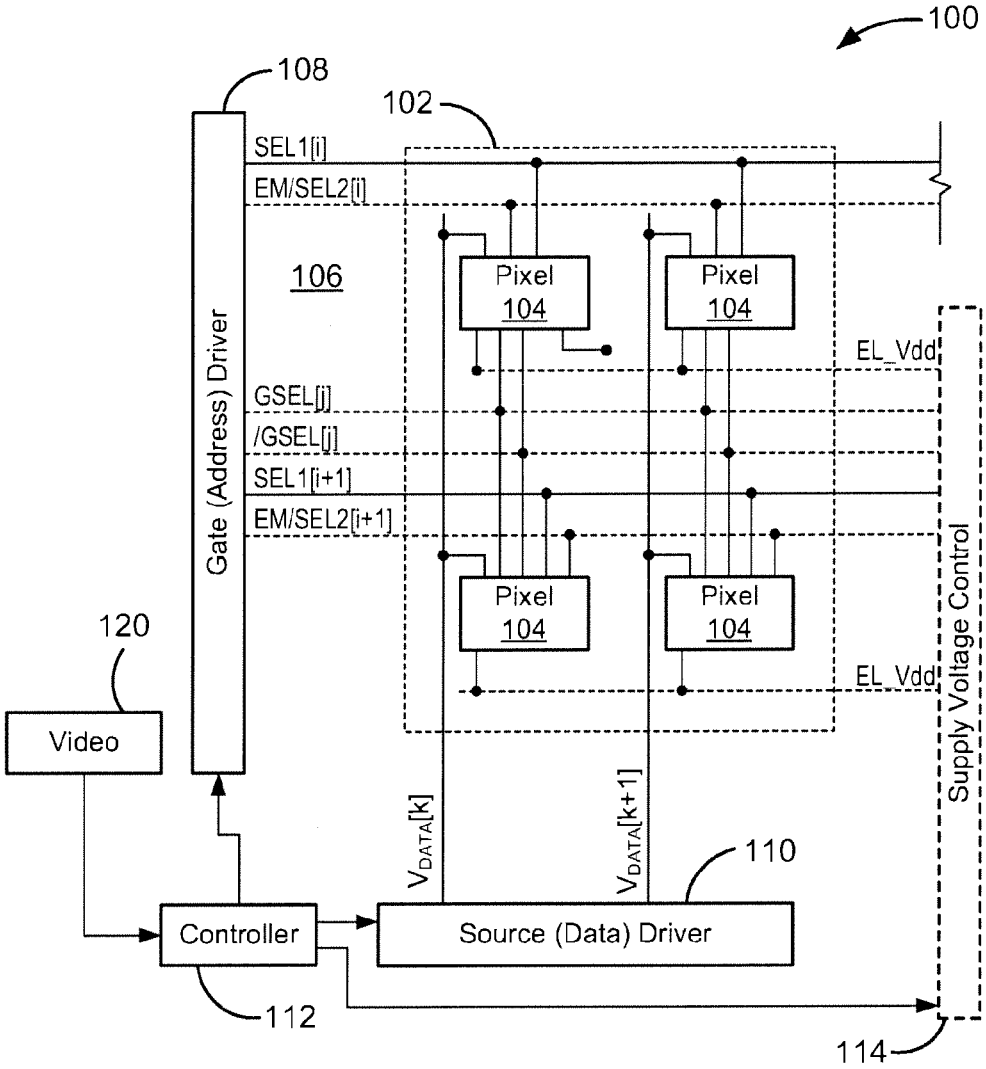
FIG. 1 is a block diagram of an AMOLED display.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

FIG. 1 is an electronic display system 100 having an active matrix area or pixel array 102 in which an array of pixels 104 are arranged in a row and column configuration. For ease of illustration, only two rows and columns are shown. External to the active matrix area of the pixel array 102 is a peripheral area 106 where peripheral circuitry for driving and controlling the pixel array 102 are disposed. The peripheral circuitry includes a gate or address driver circuit 108, a source or data driver circuit 110, a controller 112, and a supply voltage (e.g., Vdd) driver 114. The controller 112 controls the gate, source, and supply voltage drivers 108, 110, 114. The gate driver 108, under control of the controller 112, operates on address or select lines SEL[i], SEL[i+1], and so forth, one for each row of pixels 104 in the pixel array 102. A video source 120 feeds processed video data into the controller 112 for display on the display system 100. The video source 120 represents any video output from devices using the display system 100 such as a computer, cell phone, PDA and the like. The controller 112 converts the processed video data to the appropriate voltage programming information to the pixels 104 on the display 100 system 100.

In pixel sharing configurations described below, the gate or address driver circuit 108 can also optionally operate on global select lines GSEL[j] and optionally/GSEL[j], which operate on multiple rows of pixels 104 in the pixel array 102, such as every two rows of pixels 104. The source driver circuit 110, under control of the controller 112, operates on voltage data lines Vdata[k], Vdata[k+1], and so forth, one for each column of pixels 104 in the pixel array 102. The voltage data lines carry voltage programming information to each pixel 104 indicative of a brightness of each light emitting device in the pixel 104. A storage element, such as a capacitor, in each pixel 104 stores the voltage programming information until an emission or driving cycle turns on the light emitting device. The supply voltage driver 114, under control of the controller 112, controls the level of voltage on a supply voltage (EL_Vdd) line, one for each row of pixels 104 in the pixel array 102. Alternatively, the voltage driver 114 may individually control the level of supply voltage for each row of pixels 104 in the pixel array 102 or each column of pixels 104 in the pixel array 102. As will be explained, the level of the supply voltage is adjusted to conserve power consumed by the pixel array 102 depending on the brightness required.

As is known, each pixel 104 in the display system 100 needs to be programmed with information indicating the brightness of the organic light emitting device in the pixel 104 for a particular frame. A frame defines the time period that includes a programming cycle or phase during which each and every pixel in the display system 100 is programmed with a programming voltage indicative of a brightness and a driving or emission cycle or phase during which each light emitting device in each pixel is turned on to emit light at a brightness commensurate with the programming voltage stored in a storage element. A frame is thus one of many still images that compose a complete moving picture displayed on the display system 100. There are at least two schemes for programming and driving the pixels: row-by-row, or frame-by-frame. In row-by-row programming, a row of pixels is programmed and then driven before the next row of pixels is programmed and driven. In frame-by-frame programming, all rows of pixels in the display system 100 are programmed first, and all of the pixels are driven row-by-row. Either scheme can employ a brief vertical blanking time at the beginning or end of each frame during which the pixels are neither programmed nor driven.

The components located outside of the pixel array 102 can be disposed in a peripheral area 106 around the pixel array 102 on the same physical substrate on which the pixel array 102 is disposed. These components include the gate driver 108, the source driver 110 and the supply voltage controller 114. Alternatively, some of the components in the peripheral area can be disposed on the same substrate as the pixel array 102 while other components are disposed on a different substrate, or all of the components in the peripheral area can be disposed on a substrate different from the substrate on which the pixel array 102 is disposed. Together, the gate driver 108, the source driver 110, and the supply voltage control 114 make up a display driver circuit. The display driver circuit in some configurations can include the gate driver 108 and the source driver 110 but not the supply voltage controller 114.

The use of the AMOLED display system 100 in FIG. 1 for applications with bright backgrounds such as emails, Internet surfing, etc. requires higher power consumption due to the need for each pixel to serve as a light for such applications. However, the same supply voltage applied to the drive transistors of each pixel is still used when the pixel is switched to varying degrees of gray scales (brightness). The current example therefore manages the supply power of the drive transistors for video data that requires higher brightness, therefore resulting in power savings while maintaining the necessary luminescence compared to an ordinary AMOLED display with a constant supply voltage to the drive transistors.

Figure 2:
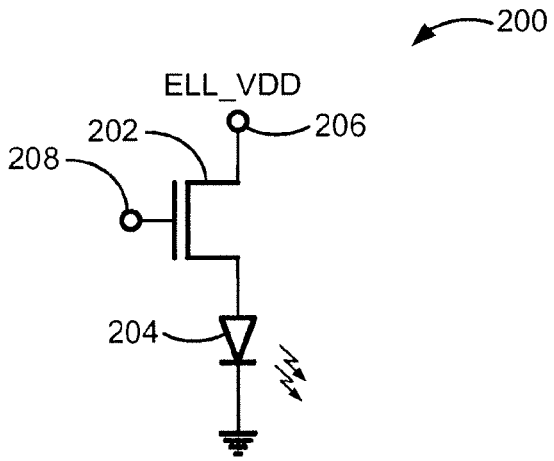
FIG. 2 is a block diagram of a pixel driver circuit for the AMOLED display in FIG. 1.

FIG. 2 is a circuit diagram of a simple individual driver circuit 200 for a pixel such as the pixel 104 in FIG. 1. As explained above, each pixel 104 in the pixel array 102 in FIG. 1 is driven by the driver circuit 200 in FIG. 2. The driver circuit 200 includes a drive transistor 202 coupled to an organic light emitting device 204. In this example, the organic light emitting device 204 is a luminous organic material which is activated by current flow and whose brightness is a function of the magnitude of the current. A supply voltage input 206 is coupled to the drain of the drive transistor 202. The supply voltage input 206 in conjunction with the drive transistor 202 creates current in the light emitting device 204. The current level may be controlled via a programming voltage input 208 coupled to the gate of the drive transistor 202. The programming voltage input 208 is therefore coupled to the source driver 110 in FIG. 1. In this example, the drive transistor 202 is a thin film transistor fabricated from hydrogenated amorphous silicon. Of course, the techniques described herein may be employed with drive transistors fabricated from other semi-conductor materials. Other circuit components such as capacitors and transistors (not shown) may be added to the simple driver circuit 200 to allow the pixel to operate with various enable, select and control signals such as those input by the gate driver 108 in FIG. 1. Such components are used for faster programming of the pixels, holding the programming of the pixel during different frames and other functions.

When the pixel 104 is required to have maximum brightness such as in applications such as e-mail or web surfing, the gate of the drive transistor 202 is driven so the transistor 202 is in saturation mode and therefore fully open allowing high current to flow through the organic light emitting device 204 creating maximum brightness. Lower levels of brightness for the light emitting device 204, such as those for lower gray scales, are controlled by controlling the voltage to the gate of the drive transistor 202 in the linear region. When the drive transistor 202 operate in this region, the gate voltage controls the current supplied to the light emitting device 204 linearly and therefore the brightness of the light emitting device. In a power saving mode in this example, the power consumption associated with the drive transistor 202 is reduced because as the drive transistor 202 is driven into saturation mode at a certain threshold voltage, a lower supply voltage above the threshold voltage will still maintain a level of current to the light emitting device 204 that produces roughly the same brightness as a higher supply voltage would.

Figure 3:
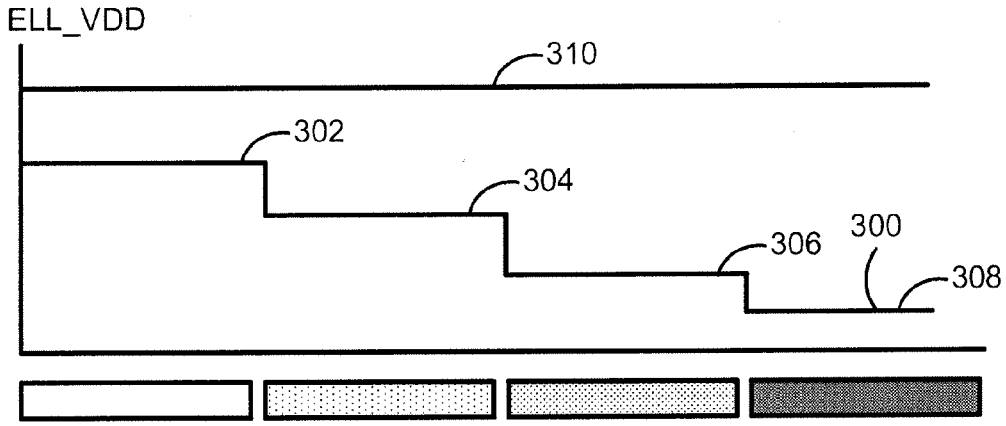
FIG. 3 is a graph of voltage levels for different modes for power consumption savings for the pixel driver circuit in FIG. 2.

FIG. 3 shows four different modes of power consumption that regulate the supply voltage level 300. A first mode has a relatively high driver voltage level 302 which results in the highest brightness. A second mode has a relatively lower voltage level 304 as the pixel is not required to be as bright such as a gray scale requiring a region to allow sufficient gate voltage control of the necessary brightness. A third mode has a lower voltage level 306 resulting in a darker shade. A fourth mode reduces the driver voltage to a low level 308. A constant supply voltage level 310 represents a conventional AMOLED driver circuit where the supply voltage is kept at one level. The varying of supply voltages to the drive transistor depending on the brightness requirements of the pixel 104 results in savings in power consumption of around 40% over a conventional OLED pixel represented by the voltage level 310. It is to be understood that there may be any number of different power supply levels.

The level of the supply voltage from the supply voltage input 206 in FIG. 2 is controlled by the voltage controller 114 in FIG. 1. The control of the supply voltage may be based on the current required by the display system 100 based on sensed display current compared to certain threshold levels. One example of measuring display current is determining the total current from the power supply connected to the display system 100. In this example, the controller 112 will compare the sensed display current with threshold levels and adjust the supply voltages supplied by the voltage controller 114 to save power consumption as the different threshold levels are exceeded. A higher current may indicate that the supply voltages may be lowered to a level that still achieves the needed brightness. A lower current will allow lower voltages to be used in situations where the pixel is largely in darker gray scales not requiring bright levels.

Alternatively, the determination may be made during video processing based on the amount of overall brightness required in a particular video frame based on the video data received from the video source 120 in FIG. 1. Such a determination could be made via video processing software on the device associated with the video source 120 using the display system 100 in FIG. 1 or by the controller 112. For example, in the cases of a smooth gradient image (gradual transition from black to full white), if the gradient stays the same between frames with no sudden jumps, contouring effects or color shifts, the controller 112 may determine that the image quality is not changed and adjustments may be made to the supply voltage. In this example, the supply voltage is controlled at the same level for each pixel in the display 100 via a common voltage supply line. However, different segments of pixels may have their supply voltages controlled independently such as the supply voltages for each row of pixels or column of pixels for more precise power saving. The independent voltage control for the drive transistors of different segments of pixels may be preferably performed for larger displays having more variation of brightness levels for a given frame over the different pixels.

The drive transistor 202 has a saturation region where current is constant against the voltage applied across the source and the drain such as the supply voltage from the supply voltage input 206 in FIG. 2. At lower gate voltage levels, the level of current through the transistor has a linear relationship with the gate voltage. A transition region exists between the linear region and the saturation region. The saturation region maintains a substantially constant current for any voltage level above the threshold voltage. Operating in saturation has been necessary due to the high contact resistance associated with an amorphous silicon thin film transistor such as the drive transistor 202 in particular.

Thus, the operating voltage for a pixel should be chosen such that the drive transistor 202 stays in deep saturation to reduce cross talk stemming from voltage drop on the supply voltage input 206 in a power saving mode. The pixel 104 is therefore programmed with a high current to the light emitting device 204 therefore making it become an almost linear function of the voltage across the drive transistor 202. In this case, the high current required for the light emitting device 204 effectively leads to source degeneration, thus reducing the effect of the voltage drop on the drive transistor 202. Also, during the leakage time, the pixel current is brought to normal levels, which further compensates for the voltage drop. As a result the display luminance stays the same. This effect reduces the power of the drive transistor 202 by over 50% and total power consumption by 40% when the pixel 104 is at the highest brightness levels required for applications such as e-mail and web browsing.

Figure 4:
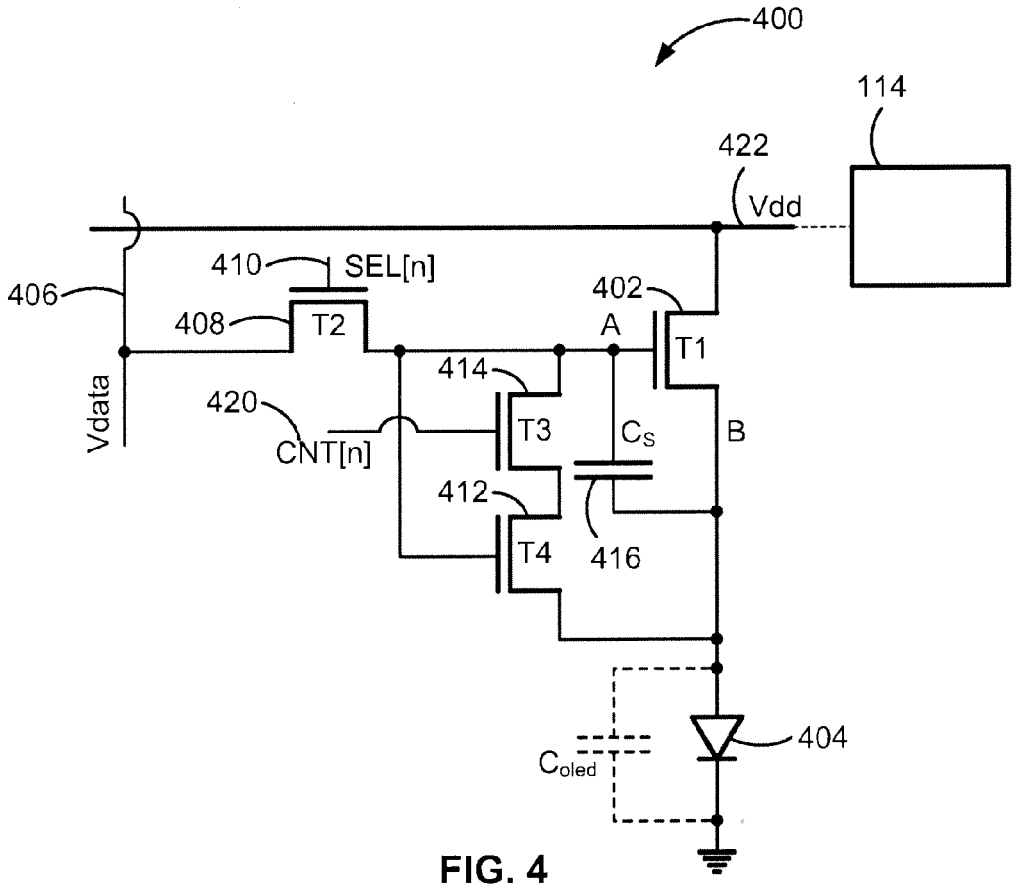
FIG. 4 is an alternate pixel driver circuit that may use the power consumption control while controlling for voltage drop and preventing threshold voltage shift.

However, since the drive transistor 202 is shifted toward the linear region of operation by lower supply voltages in order to maintain the necessary high current for the light emitting device 204, the image quality is affected by ground bouncing and voltage drop. However, since the gray scales are further apart in applications requiring primarily bright pixels such as e-mail, the image quality will not be affected significantly. In order to maintain the same luminance, the programming voltage input to the gate of the drive transistor 202 may be controlled by adjusting gamma curves. FIG. 4 shows an alternate driver circuit 400 for a display pixel such as the pixels 104 in FIG. 1 that may employ the voltage supply control but tolerate voltage drop and ground bouncing. The driver circuit 400 is capable of operating in the saturation-linear transition region or even further down in the linear region of the driver transistor, resulting in significant power reduction without causing any image artifacts.

The driver circuit 400 includes a drive transistor 402 having a source coupled to an organic light emitting device 404. A programming voltage input 406 is coupled to the gate of the drive transistor 402 through a select transistor 408. The select transistor 408 has a gate that is coupled to a select input 410. A select signal on the select input 410 allows a programming voltage signal on the program voltage input 406 to adjust the current through the drive transistor 402 to the light emitting device 404. The program voltage input 406 is coupled to the drain of the select transistor 406. The source of the select transistor 408 is coupled to the gate of the drive transistor 402 and the gate of a bias transistor 412 that is wired in series to another bias transistor 414. A source capacitor 416 is charged to the programming voltage when the select transistor 408 is turned on. A control signal input 420 is coupled to the gate of the bias transistor 414. A controlled supply voltage input 422 is coupled to the drain of the drive transistor 402. The input supply voltage 422 is controlled via a voltage controller such as the voltage controller 114 in FIG. 1 to adjust the supply voltage level and therefore save power for the driver circuit 400.

Figure 5:
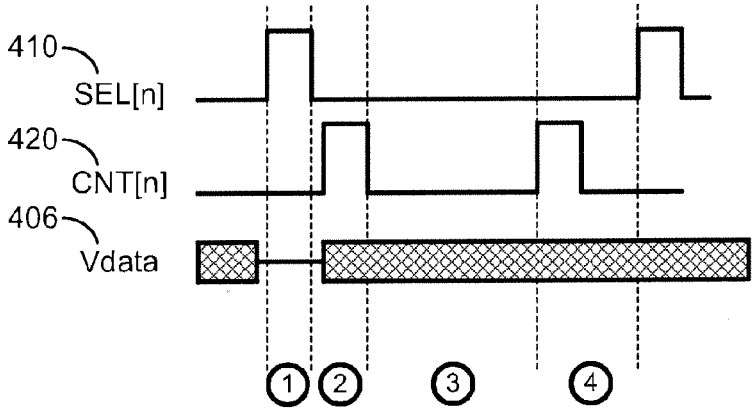
FIG. 5 is a timing diagram for the control and data signals for the driver circuit in FIG. 4.

FIG. 5 is a timing diagram of the signals for the select input 410, the control input 420 and the programming input 406 in FIG. 4 during one frame of the pixel powered by the driver circuit 400. When the select signal on the signal input 410 is input to the select transistor 408, the transistor 408 is turned on allowing the programming voltage signal input 406 to charge the source capacitor 416 to the programming voltage level that will produce the proper current flow through the drive transistor 402 to the organic light emitting device 404. This part of the cycle programs the pixel circuit 400 with the proper brightness level based on the programming voltage signal input 406. The voltage drop and ground bouncing are eliminated by the use of the bias transistors 412 and 414.

As shown in FIG. 5, the next part of the cycle turns off the select signal on the signal input 410 and turns on the control signal to the control signal input 420 coupled to the gate of the transistor 414. When the select signal on the select signal input 410 is strobed low, the select transistor 408 is turned off causing the programming voltage to be held by the stored voltage in the capacitor 416. The control signal input 420 turns on the bias transistor 414 on. The control signal on the control signal input 420 thus enables voltage compensation with charge leakage. In the next cycle, the control signal on the control signal input 420 is then strobed low which turns off the transistor 414 causing the programming voltage stored on the capacitor 416 to be coupled between the source and the gate of the drive transistor 402. The data programming voltage to the gate causes the current to the light emitting device 404 to be regulated by the drive transistor 402. The pixel is therefore turned on during this period and holds the program voltage level from the programming voltage input 106. The control signal to the control signal input 420 then goes high again which turns the pixel off and therefore relaxes the current flowing through the drive transistor 402. Because of the negative bias caused by the bias transistors 412 and 414, the transistor 402 thus recovers a significant part of the threshold voltage shift and thereby lengthens the life of the transistor 402.

The display circuit 400 in FIG. 4 is therefore off for a small part of the frame time when the control signal input 420 is strobed a second time. Since the circuit 400 is not on for most of the frame time, during the off period, the threshold voltage shift may be recovered. While the circuit is off, the drive transistor 402 is stressed with a high current level via the supply voltage signal 422. The cycle evens the threshold voltage shift of all the pixels in the display thereby reducing the effect of differential aging. The drive transistor 402 is negatively biased during the recovery period, thereby recovering a significant part of the threshold voltage shift serving to prolong the lifetime of the drive transistor 402 and therefore the pixel. This reduces the threshold voltage of the drive transistor 402 by nearly a factor of 3. The driver circuit 400 in FIG. 4 therefore allows the use of lower supply voltage to the drive transistor 402 while compensating for the effects of voltage drop and cross talk.

The driver circuit 400 in FIG. 4 also allows the compensation for voltage shifts in the threshold voltage of the drive transistor 402 due to oversaturation from the lower drive voltage levels. When a lower voltage is applied across the drive transistor 402, it may result in higher voltage threshold shift stemming from increased carriers of the channel which in turn leads to faster aging of the transistor 402. Since the voltages in FIG. 4 are relatively higher due to the bias transistor pair 412 and 414, the drive transistor 402 is not driven in transition for as much time as using a relative lower voltage therefore stabilizing long term threshold voltage shift and increasing the lifetime of the transistor 402.

Figure 6:
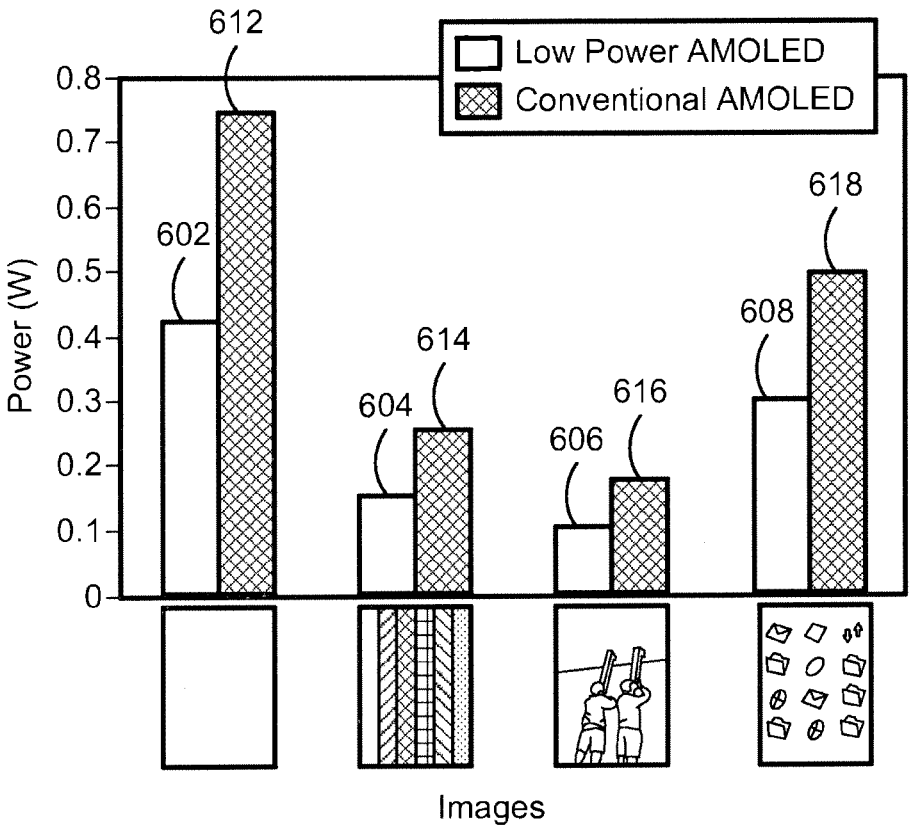
FIG. 6 is a power consumption graph of the example driver circuit against a conventional AMOLED display for different graphics images.

FIG. 6 is a graph showing the savings in power of an AMOLED pixel display using adjustable supply voltage control in comparison with a standard AMOLED pixel display using a constant supply voltage. Significant power savings may be made in applications with high brightness output. A bar 602 shows the lower power level from an AMOLED display using the procedures outlined above in comparison to a bar 612 from a standard AMOLED display when displaying a total white screen. Other applications such as a bright image (e.g., start menu) as represented by the bar 608 showing the lower power consumption of an adjustable supply voltage AMOLED display in comparison to a bar 618 showing the power consumption of a standard AMOLED display. Bars 604 and 606 show the smaller power savings in cases where the pixels are darker (less bright) in comparison to bars 614 and 616 representing the power consumed by a conventional AMOLED display.

Figure 7:
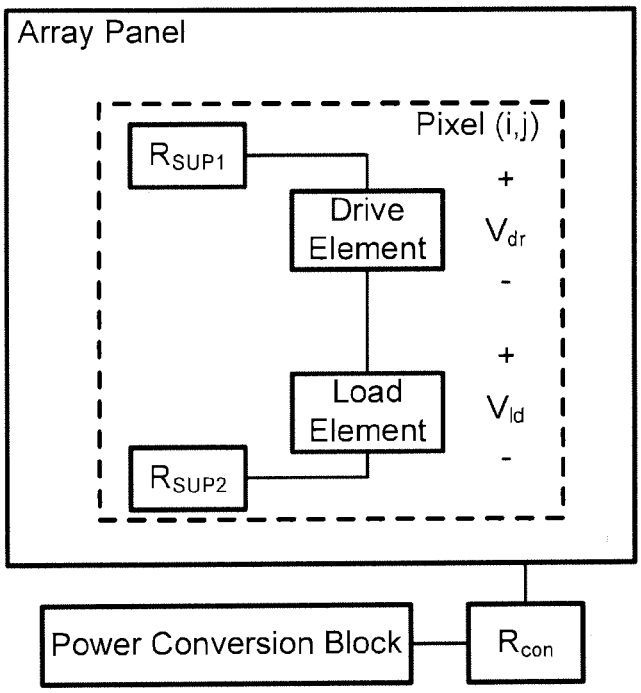
FIG. 7 is a diagrammatic illustration of the sources of power dissipation in an electroluminescent display.

FIG. 7 is a diagrammatic illustration of the sources of power dissipation in an electroluminescent display. As shown, the sources of power consumption are the parasitic resistance (contact:$R_{con}$, line resistance: $R_{sup1}$ and $R_{sup2}$), and the voltage drops across the drive element and load element. The power consumption can be reduced by improving the load efficiency to operate at lower voltage and lower current levels, and by improving the performance of the drive element to reduce the operation voltage. Also, the driving conditions can be optimized to require only the lowest possible power for any given devices.

In most displays, the supply voltage is adjusted to the worst case, which includes the worst voltage drop across the parasitic resistance plus the worst voltage drop across the drive element and load element. The supply voltage may be adjusted based on the content of the display. In this case, the supply voltage is adjusted based on long hysteresis curves to eliminate any sudden change in the display. Therefore, it does not work effectively when displaying dynamic content (e.g., videos).

Figure 8:
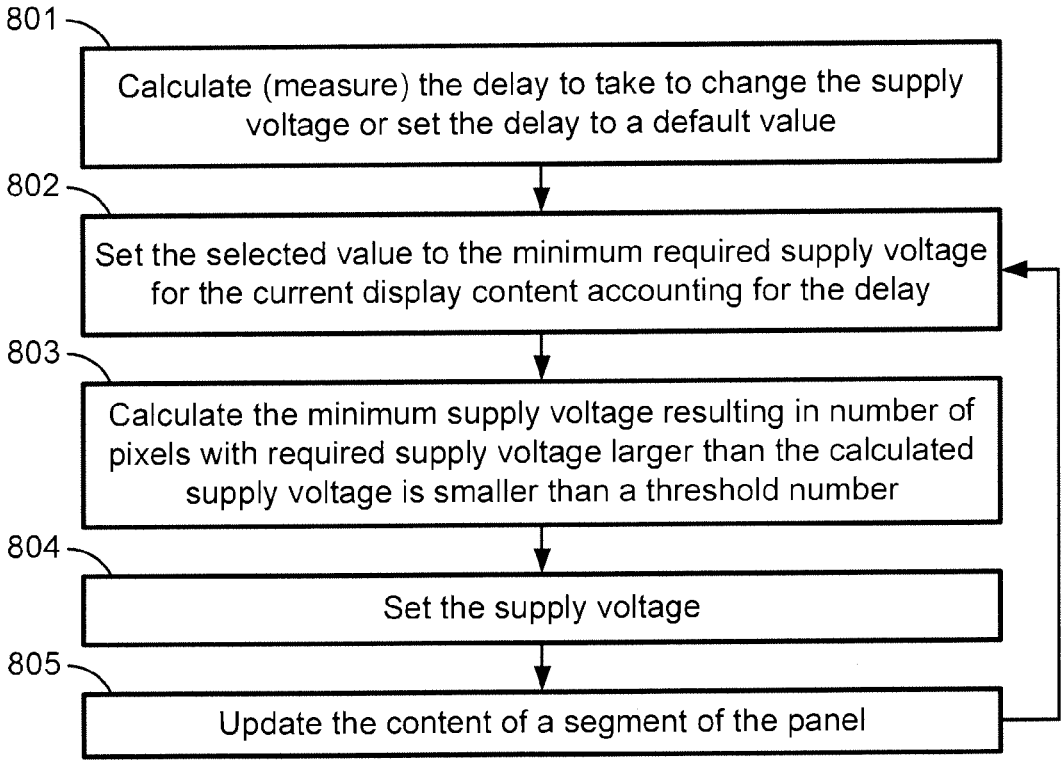
FIG. 8 is a flowchart of a technique for adjusting the supply voltage for a pixel circuit based on the content of a selected segment of a display and a predetermined threshold value.

FIG. 8 is a flowchart of one implementation of a technique for adjusting the supply voltage based on the content of a segment of the display and a threshold value. This technique eliminates the need for hysteresis curves. The supply voltage is adjusted prior to or after updating a small segment of the display. Since the change in the content of the display segment is minimal during these adjustments, the change in supply voltage is gradual. Thus, sudden changes in the voltages are avoided.

At step 801 in FIG. 8, the delay required to change the supply voltage is calculated or measured, or the delay may be set to a default value. Then at step 802 the supply voltage is set to the minimum voltage required for the current content of the display segment, accounting for the delay. Step 803 calculates the minimum supply voltage that results in a number of pixels having a required supply voltage larger than the set value, that is smaller than a predetermined threshold number. The supply voltage is then set at the calculated value at step 804, and the content of the display segment is updated at step 805.

Figure 9:
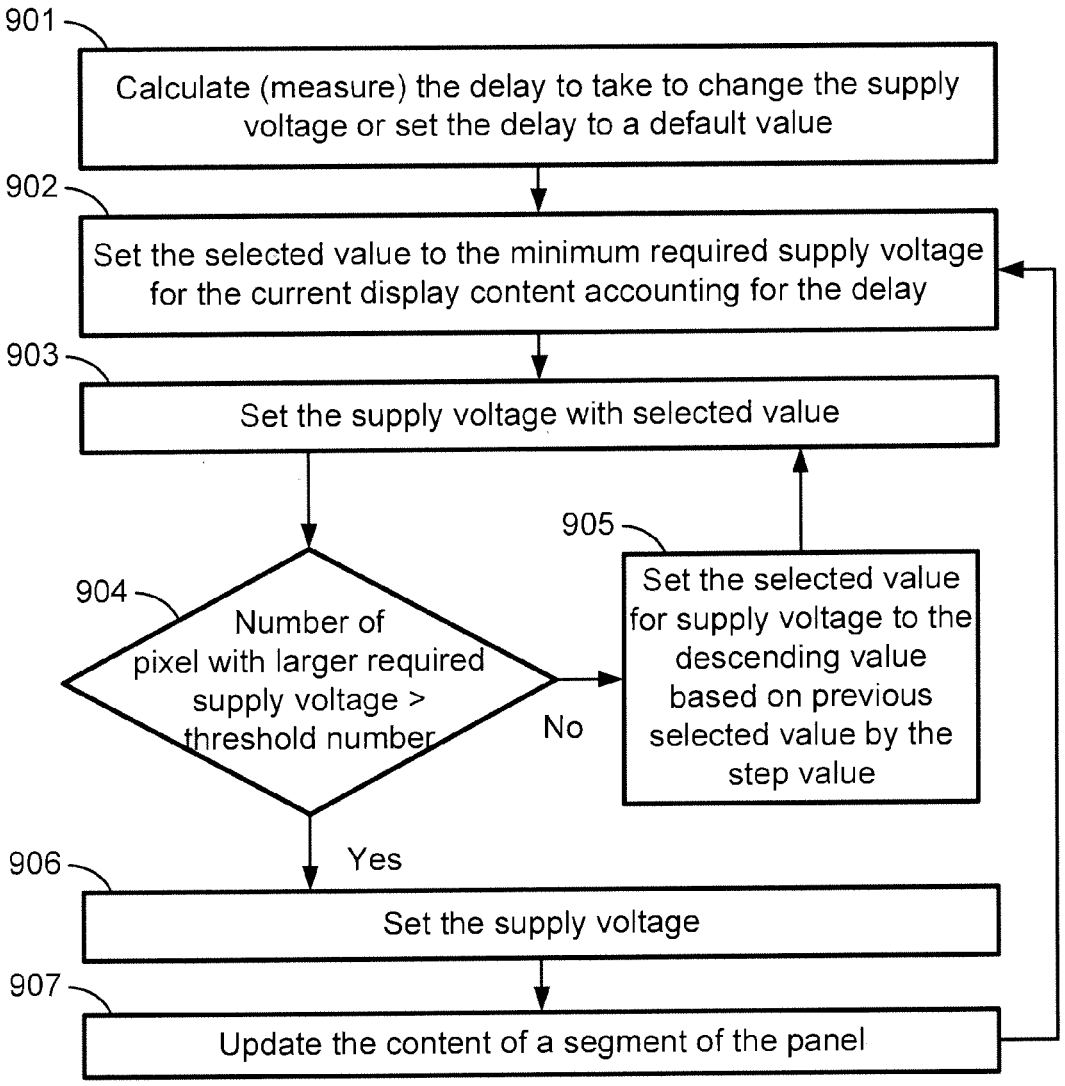
FIG. 9 is a flow chart of an algorithm for finding the value of the minimum supply voltage for the content of a selected segment of a display.

FIG. 9 is a flow chart of a detailed implementation of an algorithm for finding the value of the minimum supply voltage used in step 803 in FIG. 8. In FIG. 9, the first two steps 901 and 902 are the same as the first two steps 801 and 802 in FIG. 8. Then at step 903 the supply voltage is set to a selected value, after which step 904 determines whether the number of pixels requiring a supply voltage larger than the set value, is greater than a predetermined threshold number. The threshold number used in step 904 is defined as the number of pixels that can operate with a supply voltage smaller than the required supply voltage without substantially affecting the image quality. If the answer at step 904 is negative, step 905 reduces the set value of the supply voltage by a predetermined step amount. This enables the display to operate at lower supply voltages, since the number of pixels that require a high supply voltage, based on the image content, is typically a small number in any given image (or frame), and the step to the next lower supply voltage is large. If the answer at step 904 is positive, step 906 sets the actual supply voltage to the value selected in step 902, and then the content of the display segment is updated at step 907.

In a further embodiment, the drive element is pushed to operate in a linear regime where the drive element is sensitive to the supply voltage variation. This mode can be used for cases where the image content is limited (e.g., only few gray levels). However, the use of this operation can be extended by compensating for the supply voltage variation across the panel. Compensation for other factors of the display, such as non-uniformity or aging, should be considered since they can affect the supply voltage variation significantly. There are different techniques for extracting voltage variation across a display, and two of these techniques will be described in accordance with other compensation factors. These two techniques can be swapped with other techniques.

Figure 10:
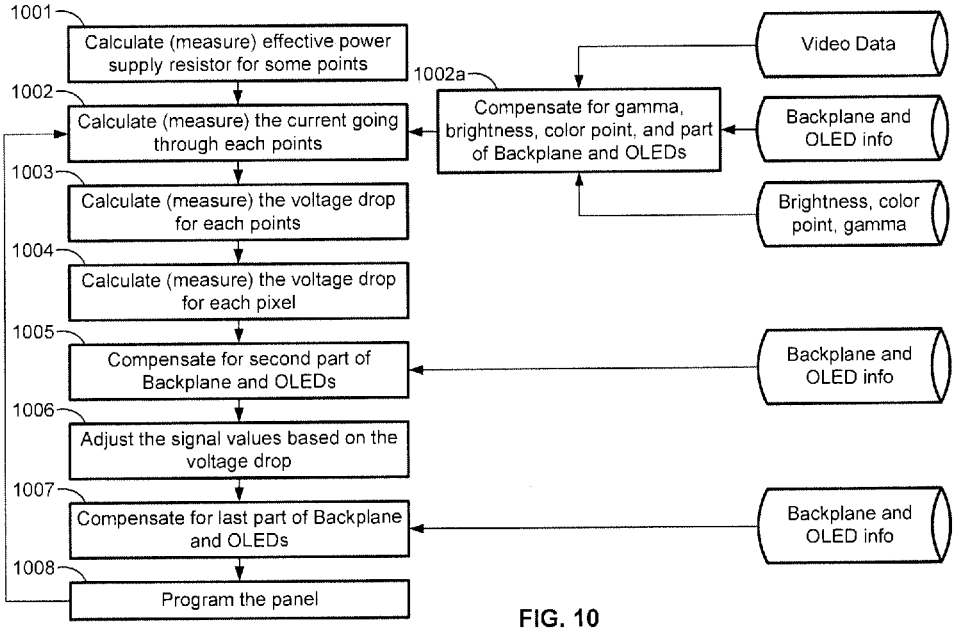
FIG. 10 is a flow chart of a procedure for compensating for the supply voltage variation in respect to other compensation factors.

FIG. 10 is a flow chart of a procedure for compensating for the supply voltage variation in respect to other compensation factors. Here, the effective resistance for a few virtual (or physical) points in the display is calculated at step 1001. The video signal is compensated for cases that can directly affect the pixel current, such as gamma, brightness, color point, and efficiency compensation of the load element, at step 1002*a*, and the current passing through each of the selected points is calculated at step 1002. Using the effective resistance of each point, the voltage drop for each point is then calculated and used to calculate the cumulative voltage drop for each point at step 1003. Using the extracted voltage drop, the effective voltage drop for each pixel is calculated at step 1004, using a different method such as interpolation.

Step 1005 compensates for the supply voltage variation and other compensation factors (e.g., the second part of the backplane and OLED's). Here, the order of compensation factors can be based on reducing the computation error and reducing the complexity of the calculation. The signal values are adjusted at step 1006, based on the pixel voltage drop. Step 1007 compensates for the last part of the backplane and OLED's), and then the display panel is programmed at step 1008.

Figure 11:
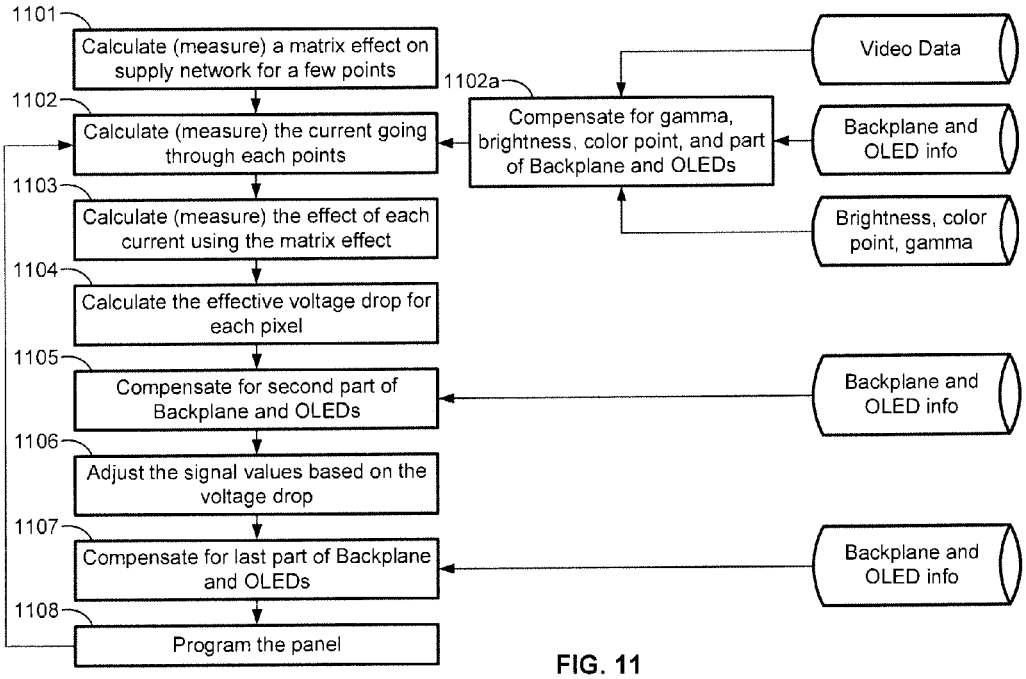
FIG. 11 is a flow chart of a modified procedure that compensates for supply voltage variations using effect matrices.

FIG. 11 is a flow chart of a modified embodiment that compensates for supply voltage variations using effect matrices. The effect matrix is measured or calculated for each point at step 1101. This matrix shows the effect of the current passing through the point, on the supply voltage of other points. Thus, the calculation of the supply voltage variation is carried out using the effect matrices, by calculating the current going through each point (step 1102), calculating the effect of each current using the matrix effect (step 1103), and calculating the effective voltage drop for each pixel step 1104). Then the same compensating, adjusting and programming steps described above are executed at steps 1105 through 1107.

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

What is claimed is:

1. A method of conserving energy in an AMOLED display having pixels that include a drive transistor and an organic light emitting device, and an adjustable source of a supply voltage for the drive transistor, the method comprising monitoring the content of a selected segment of the display, setting the supply voltage to the minimum supply voltage required for the current content of said selected segment of the display, and determining whether the number of pixels in said selected segment that require a supply voltage larger than the set value, is greater than a predetermined threshold number and, when the answer is negative, reducing the supply voltage by a predetermined step amount.

2. The method of claim 1 in which said monitoring of said content of said selected segment of the display comprises monitoring the voltage supplied to the gate input of said drive transistor input.

3. An active matrix organic light emitting device display, comprising:

an adjustable supply voltage source;

a plurality of pixels, each coupled to the adjustable supply voltage source, each pixel including:

an organic light emitting device;

a drive transistor having a source and a drain, one of which is coupled to the organic light emitting device and the other of which is coupled to the adjustable supply voltage source;

a plurality of programming voltage inputs coupled to the gates of the drive transistors of the plurality of pixels, the programming voltage inputs providing a programming voltage indicative of a desired brightness of each of the plurality of pixels; and a supply voltage controller coupled to the adjustable voltage source to regulate the level of a supply voltage supplied to each of the drive transistors, the supply voltage controller monitoring the content of a selected segment of the display, setting the supply voltage to the minimum supply voltage required for the current content of said selected segment of the display, and reducing the supply voltage by a predetermined step amount when the number of pixels in the selected segment that require a supply voltage larger than the set value, is greater than a predetermined threshold number.

4. The active matrix organic light emitting device display of claim 3 in which said content of said selected segment of the display is monitored by monitoring the voltage supplied to the gate input of said drive transistor input.

* * * * *